US007866918B2

(12) United States Patent
Otto

(10) Patent No.: US 7,866,918 B2
(45) Date of Patent: Jan. 11, 2011

(54) SOIL STABILIZATION AND IRRIGATION ARRANGEMENT

(75) Inventor: Werner Otto, Waldspitze 23, D-90518 Altdorf (DE)

(73) Assignee: Werner Otto, Altdorf (DE)

( * ) Notice: Subject to any disclaimer, the term of this patent is extended or adjusted under 35 U.S.C. 154(b) by 0 days.

(21) Appl. No.: 11/816,942

(22) PCT Filed: Sep. 6, 2006

(86) PCT No.: PCT/EP2006/008692

§ 371 (c)(1),
(2), (4) Date: Feb. 6, 2008

(87) PCT Pub. No.: WO2008/028504

PCT Pub. Date: Mar. 13, 2008

(65) Prior Publication Data

US 2010/0040420 A1 Feb. 18, 2010

(51) Int. Cl.
*E02B 11/00* (2006.01)
*A01G 25/00* (2006.01)
*B32B 3/30* (2006.01)

(52) U.S. Cl. ..... 405/36; 405/302.7; 428/167

(58) Field of Classification Search ..... 405/36, 405/52–54, 302.4, 302.6, 302.7; 428/128, 428/167

See application file for complete search history.

(56) References Cited

U.S. PATENT DOCUMENTS 202,331 A * 4/1878 Conway ..... 405/36
1,765,652 A * 6/1930 Burgess ..... 404/21
2,067,356 A * 1/1937 Swinhoe ..... 405/39
2,879,646 A * 3/1959 Brandt ..... 405/57
3,960,375 A * 6/1976 Bibi-Roubi et al. ..... 472/92
4,576,511 A * 3/1986 Vidal, Jr. ..... 405/37
4,881,846 A * 11/1989 Burkstaller ..... 405/37
5,052,161 A * 10/1991 Whitacre ..... 52/385
5,120,157 A * 6/1992 Todd et al. ..... 405/36
5,256,007 A * 10/1993 Allen ..... 405/302.4
5,383,314 A * 1/1995 Rothberg ..... 52/169.5

FOREIGN PATENT DOCUMENTS

DE 200 19 812 4/2002
DE 20 2005 006256 8/2006

* cited by examiner

*Primary Examiner*—Tara Mayo-Pinnock
(74) *Attorney, Agent, or Firm*—Occhiuti Rohlicek & Tsao LLP

(57) ABSTRACT

A soil stabilization and irrigation arrangement is proposed, comprising a useable area (10) and a water compensating device (22) disposed outside the useable area (10). The useable area (10) is formed from a basin (14) which is constructed as watertight and in which a drainage device (18) is arranged near the bottom, and which contains a footing (20); the water compensating device (22) is formed from a water receiving space (23) which is provided with a water inlet (24) and a water outlet (26) and which is in communication with the drainage device (18) of the useable area (10); and the useable area (10) further comprises an arrangement of soil stabilizing mats (32) in the footing (20) above the drainage device (18), wherein the soil stabilizing mats (32) are embodied as permeable to water.

8 Claims, 1 Drawing Sheet

SOIL STABILIZATION AND IRRIGATION ARRANGEMENT

CROSS-REFERENCE TO RELATED APPLICATIONS

This application is being filed as a U.S. National Stage under 35 U.S.C. 371 of International Application No. PCT/EP2006/008692 filed on Sep. 6, 2006, the content of which is hereby incorporated by reference in its entirety.

BACKGROUND OF THE INVENTION

1. Field of the Invention

The present invention relates to a soil stabilisation and irrigation arrangement comprising a useable area and a water compensating device disposed outside the useable area, and in particular such a soil stabilisation and irrigation arrangement for riding arenas and similar.

2. Technical Background

A soil stabilisation and irrigation arrangement is known, which operates according to the ebb-flow principle and is supplied, for example, by Klinkert Reitplatz- und Sportplatzbau GmbH, Germany. This soil stabilisation and irrigation arrangement comprises a useable area formed from a recess in the ground which is provided with a watertight liner, in which drainage pipes are arranged near the bottom, and which contains a footing of fine sand, and a water compensating well disposed adjacent to the useable area, which is formed from a water receiving space provided with a water inlet and a water outlet and into the interior of which the drainage pipes of the useable area project. The moisture content of the footing is automatically regulated by means of the water compensating well and can be adjusted as required for various applications.

SUMMARY OF THE INVENTION

The object of the invention is to develop an improved soil stabilisation and irrigation arrangement which achieves a higher stability, elasticity and water permeability of the footing.

This object is solved by a soil stabilisation and irrigation arrangement comprising a useable area, this useable area being formed from a basin which is constructed as watertight and in which a drainage device is arranged near the bottom, and which contains a footing of fine sand, and a water compensating well disposed outside the useable area, this water compensating device being formed from a water receiving space which is provided with a water inlet and a water outlet and which is in communication with the drainage device of the useable area. According to the invention, the useable area further comprises an arrangement of soil stabilising mats in the footing above the drainage device, these soil stabilising mats being embodied as permeable to water.

Depending on the embodiment, the soil stabilising mats in the footing increase the stability and the elasticity of the footing to the desired extent. As a result of the soil stabilising mats, it is also possible to construct the footing as thinner and coarser-grained, whereby the water permeability of the footing can be increased.

In one embodiment of the invention, the soil stabilising mats comprise a base body with gaps in its thickness direction to achieve the water permeability.

In a preferred embodiment of the invention, the soil stabilising mats comprise a base body with a plurality of projections on its upper side. In this case, these projections preferably contain two groups of projections which have different heights and are arranged alternately. The projections on the upper sides of the soil stabilising mats, for example, give increased grip for horses. Alternatively, however, it is also possible that the soil stabilising mats comprise a base body with a smooth upper side.

In a further embodiment of the invention, the soil stabilising mats comprise a base body with a plurality of continuations on its lower side. These continuations serve to stabilise the position of the soil stabilising mats in the footing.

The basin of the useable area is preferably a recess in the soil which is lined with a watertight film and the drainage device of the useable area is formed by drainage pipes which extend into the water compensating device. The water compensating device is further provided with a measuring device to detect the water level in the water compensating device.

BRIEF DESCRIPTION OF THE DRAWINGS

The above and further features and advantages of the invention can be better understood from the following description of a preferred, non-restrictive exemplary embodiment with reference to the appended drawings. In the figures.

DETAILED DESCRIPTION OF A PRESENTLY PREFERRED EXEMPLARY EMBODIMENT

Figure 1:
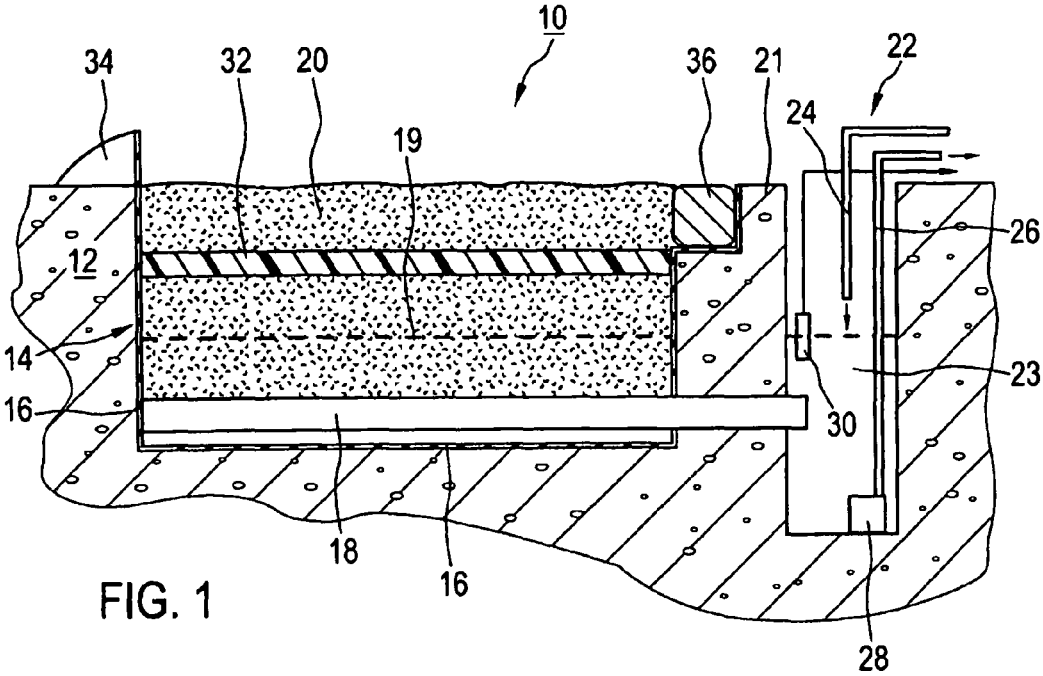
FIG. 1 is a schematic sectional view to explain the structure of a soil stabilisation and irrigation arrangement according to the present invention.

FIG. 1 first illustrates the structure of a soil stabilisation and irrigation arrangement according to the invention using the ebb-flow system. The structure of this soil stabilisation and irrigation arrangement is based on the conventional soil stabilisation and irrigation arrangement supplied by Klinkert Reit- und Sportplatzbau GmbH.

The soil stabilisation and irrigation arrangement contains a useable area 10 which can be used in particular as a riding ground, a sports ground or similar. This useable area 10 is formed by a footing 20 which, for example in the case of a riding ground, is formed from sand. The footing 20 is poured into a basin 14 which, for example, is formed from a recess in the ground 12 and which is lined with a watertight film 16 to make the basin 14 watertight.

The useable area 10 can furthermore be bounded by an earth wall 34 and/or by border copings 36.

A drainage device 18 in the form of a plurality of drainage pipes is arranged in the bottom area of the basin 14. The water level 19 in the useable area 10, more accurately in the footing 20, can be regulated from below by means of these drainage pipes 18 in order to thus adjust the moisture content of the footing 20 as required.

As shown in FIG. 1, an arrangement of soil stabilising mats 32 is further integrated in the footing 20 above the drainage device 18. These soil stabilising mats 32 are constructed as watertight and increase the stability and the elasticity of the footing 20 so that as a result of inserting the soil stabilising mats 32 into the footing 20, this can be constructed as thinner and from a coarser-grained sand. This in turn increases the water permeability of the footing 20 and thus the functionality of the entire arrangement.

As is indicated in FIG. 1, the soil stabilising mats 32 are arranged in the footing, for example, at the level of the lower edge of the border coping 36. However, the present invention is naturally not only restricted to this arrangement.

Figure 2:
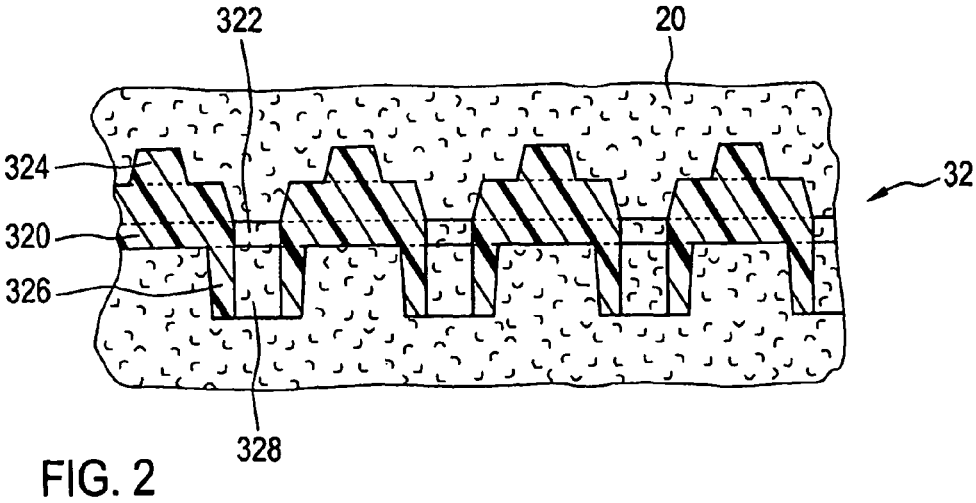
FIG. 2 is a schematic sectional view of soil stabilising mats which can be inserted in the soil stabilisation and irrigation arrangement from FIG. 1.

A soil stabilising mat 32, such as that which can be advantageously used in the soil stabilisation and irrigation arrangement according to the invention, is shown as an example in FIG. 2.

As is shown in simplified form in FIG. 2, the soil stabilising mats 32 integrated in the footing 20 have a plate-like base body 320 made of a preferably elastic plastic material. In order to ensure the water permeability of the arrangement, this base body 320 comprises gaps 322 in the thickness direction of the base body 320.

A plurality of knob-like projections 324, for example, in the form of a truncated cone, is arranged on the upper side of the base body 320. These projections 324 preferably comprise two groups of projections which have different heights and are arranged alternately. These projections 324 on the upper side of the base body 320 increase the elastic effect and the grip of the soil stabilising mats 32. The projections 324 however can naturally also be provided with only one standard height, with different shapes and arbitrary numbers, sizes and arrangements to adapt the soil stabilising mats 32 to the individual needs of the useable area 10.

In this case, the gaps 322 in the base body 320 of the soil stabilising mats 32 are formed between the projections 324.

In addition, a plurality of continuations 326, which can be embodied as hollow cylinders, for example, can be provided on the underside of the base body 320 out being restricted to this geometrical shape. The continuations 326 serve to stabilise the position of the soil stabilising mats 32 in the footing 20.

In a preferred embodiment, the continuations 326 additionally comprise through holes 328 which are constructed in alignment with the gaps 322 in the base body 320.

The soil stabilising mat 32 illustrated in FIG. 2 is known, for example, from DE 200 19 812 U1. Reference is therefore made to this document with regard to further features and advantages of such a soil stabilising mat 32. However, the present invention is in no way restricted to this embodiment of the soil stabilising mat 32. For example, the upper side of the soil stabilising mats used can also be embodied as smooth, i.e., without projections or knobs.

Any mechanical treatment of the footing surface is also not hindered by the inserted soil stabilising mats. On the contrary, the drainage pipes 18 are additionally protected by the soil stabilising mats 32.

Again with reference to FIG. 1, a water compensating device 22 is provided outside the useable area 10, separated by a dividing layer 21 soil 12.

This water compensating device 22 is constructed, for example, in the fashion of a well and contains a water receiving space 23 into the interior of which the drainage pipes 18 project through the dividing layer 21. The water receiving space 23 further comprises a water inlet 24, a water outlet 26 with relevant pump 28 and a water level detector 30 to detect the water level 19 in the water compensating device 22.

Since the drainage pipes 18 of the useable area 10 are connected to the interior of the water compensating device 22, the water level 19 in the water compensating device 22 is the same as the water level 19 in the useable area 10. Consequently, the water level 19 in the useable area 10 can be automatically adjusted by means of the water inlet 24 and the water outlet 26 by adjusting the water level 19 in the water compensating device 22 which is monitored by means of the water level detector 30 in order to achieve an optimally adjusted moisture content of the footing 20. Depending on the use of the footing 20, its moisture content can be adjusted differently.

REFERENCE LIST

10 Useable area
12 Soil
14 Basin
16 Film
18 Drainage pipes
19 Water level
20 Footing
21 Dividing layer
22 Water compensating device
23 Water receiving space of 22
24 Water inlet
26 Water outlet
28 Pump
30 Water level detector
32 Soil stabilising mats
34 Wall
36 Border coping
320 Base body
322 Gaps
324 Projections on the upper side of 320
326 Continuations on the underside of 320
328 Through holes of 326

The invention claimed is:

1. A soil stabilization and irrigation arrangement comprising:

a useable area to be used as a riding ground, the useable area being formed from a watertight basin, having a drainage device arranged near a bottom thereof, and which contains a sand footing; and a water compensating device disposed outside the useable area and in communication with the drainage device, the water compensating device being formed from a water receiving space and having a water inlet and a water outlet, wherein the useable area further comprises an arrangement of water-permeable soil stabilizing mats in the footing above the drainage device, each of which has a plate-shaped base body made of elastic plastic material, and gaps in a direction of thickness of the base body to ensure water permeability thereof.

2. The soil stabilization and irrigation arrangement according to claim 1, wherein the soil stabilizing mats comprise a base body provided with a plurality of projections on an upper side thereof.

3. The soil stabilization and irrigation arrangement according to claim 2, wherein the projections on the upper side of the base body of the soil stabilizing mats comprise two groups of projections that have different heights and are arranged alternately.

4. The soil stabilization and irrigation arrangement according to claim 1, wherein the soil stabilizing mats comprise a base body provided with a smooth upper side.

5. The soil stabilization and irrigation arrangement according to claim 1, wherein the soil stabilizing mats comprise a base body provided with a plurality of continuations on a lower side thereof.

6. The soil stabilization and irrigation arrangement according to claim 1, wherein the basin of the useable area comprises a watertight film that lines a recess in the soil.

7. The soil stabilization and irrigation arrangement according to claim 1, wherein the drainage device of the useable area comprises drainage pipes that extend into the water compensating device.

8. The soil stabilization and irrigation arrangement according to claim 1, wherein the water compensating device further comprises a measuring device for detecting a water level in the water compensating device.

* * * * *